US005249488A

United States Patent [19]

Aguilar

[11] Patent Number: 5,249,488

[45] Date of Patent: Oct. 5, 1993

[54] OIL FILTER REMOVER

[76] Inventor: Alfonso Aguilar, 904 Bolivia, El Paso, Tex. 79903

[21] Appl. No.: 7,900

[22] Filed: Jan. 22, 1993

[51] Int. Cl.[5] ..... B25B 13/32

[52] U.S. Cl. ..... 81/90.2; 81/90.3; 81/3.44

[58] Field of Search ..... 81/3.4, 3.41, 3.44, 81/64, 90.1-90.7, 92, 91.3, 100, 111, 112, 116, 126, 128

*Primary Examiner*—D. S. Meislin

[57] ABSTRACT

A lever actuated oil filter remover is presented. At least two arcuate shell-like coupling elements are coupled together inside a casing by a spider arm. An interior cam on the casing can mate with an external cam on the arcuate elements so that the diameter of the arcuate elements increases or decreases as a function of whether or not the cams are mating. A lever coupled to the aft end of the spider arm and the aft end of the casing moves the spider arm fore and aft in relation to the casing, permitting the arcuate elements to selectively grasp and release a prior art oil filter more quickly and easily than with prior art oil filter removers. The preceding elements are coupled by appropriate coupling means such as pins.

2 Claims, 1 Drawing Sheet

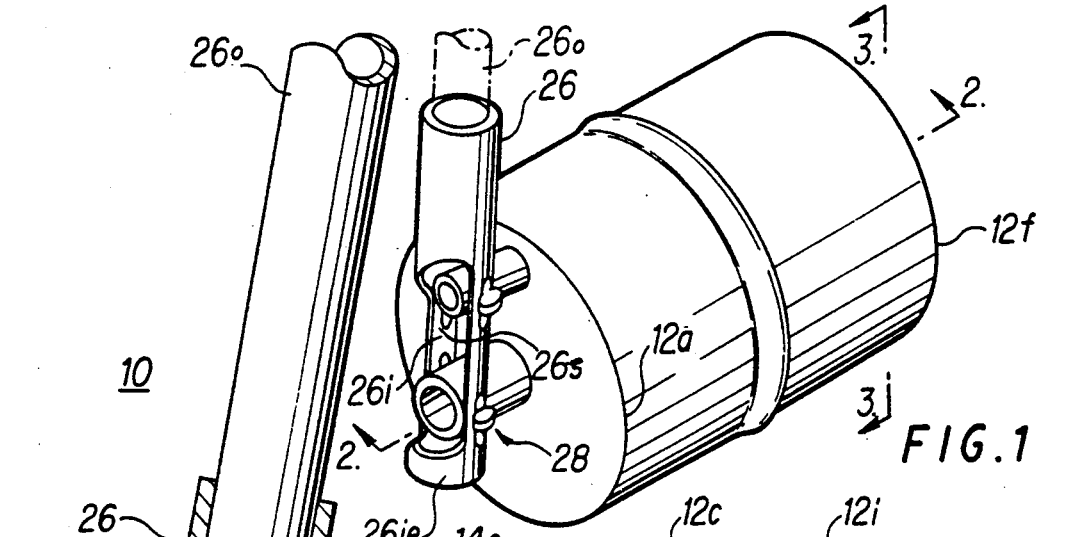
FIG. 1
FIG. 2
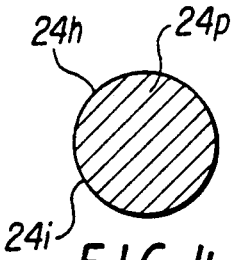
FIG. 4
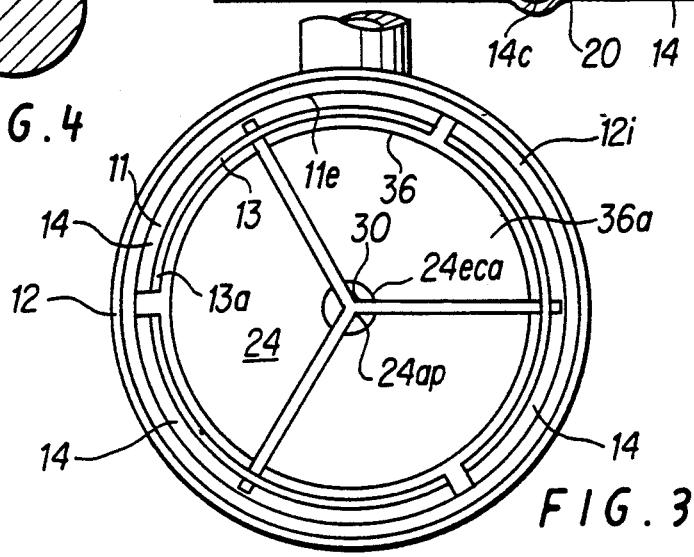
FIG. 3

OIL FILTER REMOVER

BACKGROUND OF THE INVENTION

1. Field of the Invention

The present invention relates to tools used to remove oil filters when oil filters are replaced in vehicles.

2. Description of the Prior Art

Oil lubricates vehicle engines, thereby reducing friction and wear in vehicle engines. Small particles and chemicals gradually enter the oil during engine operation and dirty the oil, making the oil less efficient and increasing engine friction and wear and eventually endangering the engine. If the oil is filtered, the rate of dirtying of the oil is decreased, and the oil can lubricate the engine for a longer period of time of operation of the engine. Even with a filter, the oil gradually dirties and must eventually be replaced. The filter removes unwanted material from the oil so that the filter also gradually dirties. Accordingly, the filter is frequently replaced when the oil is replaced.

The oil filter is normally within a container which is unscrewed to remove the oil filter. Because of a desire to make the engine compartment of as small a volume as possible, the oil filter is frequently squeezed into a hard to reach volume within the engine compartment. The engine is usually hot and those removing oil filters sometimes burn themselves when removing the oil filter. The time necessary to remove the oil filter is a function of oil filter placement within the engine compartment. If it is well placed, it only takes about 3 minutes, but in other vehicles such as certain Hyundais, Dodges, and Chevrolets, it may take as much as 20 minutes. The oil filter has residual oil which may dirty the hands of the person removing the oil filter.

What is needed, but not provided by the prior art to applicant's knowledge, is an inexpensive tool permitting oil filter removal in a short time without the problems which plague the prior art.

SUMMARY OF THE INVENTION

A lever actuated oil filter remover is presented. The oil filter remover is useful for removing and installing oil filters and comprises at least two and in a preferred example three generally identical coaxial about an axis arcuate shell-like coupling elements having fore and aft ends. The exterior surface of each arcuate shell-like coupling element is indented to protrude and define a circumferentially arcuate camming surface.

One ring spring couples each arcuate shell-like coupling element to each adjacent arcuate shell-like coupling element to cause the interior surfaces of the arcuate shell-like coupling elements to form a generally circular cylinder having a generally circular cylindrical shaped interior surface. The interior surface formed by the arcuate shaped elements coupling surfaces is of diameter incrementally greater than but about equal to the diameter of an oil filter. Said cylinder has an open fore end defined by the fore ends of the arcuate elements, which fore end fots over an oil filter for installation and removal.

A generally axially symmetric spider arm is coupled to the aft ends of each arcuate shell-like coupling element to leave the cylinder open at the fore end. The interior surface of the spider arm defines an axial spider post.

A generally axially symmetric circular cylindrical casing of interior diameter slightly greater than the exterior surface of the cylinder formed by the arcuate elements surrounds and encloses the coaxial arcuate shell-like elements and the spider arm. Said casing has fore and aft ends and is disposed around the spider arm and identical coaxial arcuate shell-like coupling elements coupled to the spider arm. The fore end of the casing is open. The interior surface of the casing defines a circumferential camming surface. The casing camming surface mates with circumferential camming surfaces defined by the exterior surface of the arcuate elements. The aft end exterior surface of the casing defines an away from axis near circumference lever post parallel to the axis. The interior surface of the lever post defines lever arm coupling means comprising a lever post hole therethrough parallel to the axis. A lever post pin is slideably coupled to the lever post interior surface in the hole. The casing aft end comprises an aft end surface which has an axial interior surface defining an axial casing post hole perpendicular to the axis through which is coupled the spider post.

The spider arm comprises an axial post axially disposed about the axis and an element coupling arm coupled from the axial post to each arcuate element to move the elements fore and aft as a function of axial post fore and aft movement. The spider arm has an aft end surface which includes an aft end interior surface defining a lever post hole therethrough perpendicular to the axis and parallel to post hole. A pin is slideably coupled within the surface. A lever arm has outer and inner ends. The lever arm has an interior surface defining a lever slot. The lever slot has an interior surface defining lever slot holes which mate with the pin so that the lever can force the spider arm fore and aft as the lever outer end is moved in the opposite direction generally parallel to the axis . Movement of the spider arm fore or aft moves (depending on the previous orientation) camming surfaces defined by the casing and arcuate elements together to spread the arcuate elements or apart to reduce the diameter of tile arcuate elements, thereby causing the arcuate elements to selectively grasp or release an oil filter for insertion or removal.

DRAWING DESCRIPTION

Reference should be made at this time to the following, detailed description which should be read in conjunction with the following drawings of which:

FIG. 1 is a ¾ view of the cylinder of the invention;

FIG. 2 is a partially cut away side view of the invention;

FIG. 3 is an view of the fore end of the casing of the invention; and

FIG. 4 is a partially cut away view of a pin and pin hole of the invention.

DETAILED DESCRIPTION OF THE INVENTION

An oil filter remover 10 is presented. The oil filter remover 10 comprises at least two and in a preferred example three generally identical coaxial about an axis 30 arcuate shell-like coupling elements 14, having fore ends 15 and aft ends 17. The exterior surface 19 of each arcuate shell-like coupling element 14 is indented circumferentially to define a circumferentially arcuate camming surface 20.

One ring spring 16 couples each arcuate shell-like coupling element to each adjacent arcuate shell-like coupling element 14 to cause the interior surfaces 13 of the arcuate shell-like coupling elements 14 to form a generally circular cylinder 11 having a generally circular cylindrical shaped interior surface 13*a*. The interior surface 13*a* formed by the arcuate shaped elements 14 coupling surfaces 13 is of diameter about equal to the diameter of an oil filter (not shown) said cylinder 11 having an open fore end defined by the fore ends 15 of the arcuate elements 14.

A generally axially symmetric spider arm 24 is coupled to the aft ends 17 of each arcuate shell-like coupling element 14 to leave the cylinder 11 open at the fore end 15*a*. The interior surface 36 of the spider arm 24 defines an axial hole 36*a* therethrough.

A generally axially symmetric circular cylindrical casing 12 of interior diameter slightly greater than the exterior surface 11*e* of the cylinder 11 formed by the arcuate elements 14 surrounds and encloses the coaxial arcuate shell-like elements 14 and the spider arm 24. Said casing 12 has fore end 12*f* and aft end 12*a* and is disposed around the spider arm 24 and identical coaxial arcuate shell-like coupling elements 14 coupled to the spider arm 24. The fore end 12*f* of the casing 12 is open. The interior surface 12*i* of the casing 12 defines a circumferential camming surface 12*c*. Camming surface 12*c* mates with circumferential camming surfaces 14*c* defined by the exterior surface 14*e* of the arcuate elements 14. The camming surfaces 14*c* comprise the camming surface 20.

The aft end 12*a* of the casing 12 defines a near circumference lever post 22 parallel to the axis 30. The interior surface 22*i* of the lever post 22 defines a lever post hole 22*h* therethrough perpendicular to the axis 30. A lever post pin 22*p* is slideably coupled to the lever post interior surface 22*i* in the hole 22*h*. The casing aft end 12*a* comprises an aft end surface 12*a* which has an axial interior surface 12*ai* defining an axial casing post hole 12*h* parallel to the axis 30.

The spider arm comprises an axial post 24*ap* axially disposed about axis 30. The spider arm 24 comprises an element coupling arm 24*eca* coupled from axial post 24*ap* to each arcuate element 14 to move the elements 14 fore and aft as a function of axial post 24*ap* fore and aft movement. The spider arm has an aft end surface 24*a* which includes an aft end interior surface 24*aei* defining a lever post hole 24*h* therethrough perpendicular to the axis 30 and parallel to post hole 22*h*. A pin 24*p* is slideably coupled within surface 24*i*. A lever arm 26 has outer and inner ends 26*o* and 26*ie*. The lever arm 26 has an interior surface 26*i* defining a lever slot 26*s*. The lever slot 26*s* has an interior surface 26*is* defining lever slot holes 26*h* which mate with the pins 22*p* and 24*p* so that lever 26 can force spider arm 24 fore and aft as the outer end 26*o* is moved in the opposite direction generally parallel to axis 30. Movement of spider arm 24 fore or aft moves (depending on the previous orientation) camming surfaces 12*c* and 14*c* together to spread elements 14 or apart to reduce the diameter of arcuate elements 14, thereby causing arcuate elements to selectively grasp or release an oil filter (not shown) for insertion or removal (not shown).

In operation, the lever arm 26 is moved to a first position to move cam surfaces 20, 12*c* together if it is desired to separate coupling elements 14 sufficiently to release an oil can (not shown) or slide the invention 10 over an oil can, and the lever arm is moved to the opposite position to separate the camming surfaces 20, 12*c* to cause the camming surfaces 20, 12*c* to force the coupling elements 14 fore ends 14*e* closer together to grasp and hold an oil can, a quicker, more efficient procedure than known to the prior art.

A particular example of the invention has been disclosed herein. Other examples will be obvious to those skilled in the art. The invention is limited only by the following claims.

I claim:

1. A lever actuated oil filter remover, comprising:

at least two generally identical coaxial about an axis arcuate shell-like coupling elements having fore and aft ends, the exterior surface of each arcuate shell-like coupling element combining and protruding to define a ring like circumferentially arcuate protruding camming surface;

one ring spring coupling each arcuate shell-like coupling element to each adjacent arcuate shell-like coupling element to cause the interior surfaces of the arcuate shell-like coupling elements to form a generally circular cylinder having a generally circular cylindrical shaped interior surface, the interior surface formed by the arcuate shaped elements coupling surfaces being of diameter incrementally greater than but about equal to the diameter of an oil filter and said cylinder having an open fore end defined by the fore ends of the arcuate elements;

a generally axially symmetric spider arm coupled to the aft ends of each arcuate shell-like coupling element to leave the cylinder open at the fore end wherein the aft exterior surface of the spider arm defines an axial spider post;

a generally axially symmetric circular cylindrical casing of interior diameter slightly greater than the exterior surface of the cylinder formed by the arcuate elements surrounding and enclosing the coaxial arcuate shell-like elements and the spider arm wherein the casing has fore and aft ends and is disposed around the spider arm and identical coaxial arcuate shell-like coupling elements coupled to the spider arm, the fore end of the casing is open, and the interior surface of the casing defines a circumferential camming surface aligned to be capable of mating with exterior circumferential camming surfaces defined by the exterior surface of the arcuate elements, the aft end exterior surface of the casing defines an away from axis near circumference lever post generally parallel to the axis, the interior surface of the lever post defines lever arm coupling means, the casing aft end further comprises an aft end surface which has an axial interior surface defining an axial casing post hole perpendicular to the axis through which is coupled the spider post;

the spider arm comprises the axial post axially disposed about the axis and an element coupling arm coupled from the axial post to each arcuate element to move the elements fore and aft as a function of axial post fore and aft movement, The spider arm has an aft end surface which defines lever coupling means;

a lever arm having outer and inner ends, the inner end including coupling means coupling the inner end to the end of the spider arm post, and coupling means rotatably coupling the adjacent part of the lever arm to the casing post, wherein moving the element cam into the casing cam increases the diameter of the cylinder formed by the elements and moving the element cam out of the casing cain decreases the interior diameter of the cylinder formed by the elements to the exterior diameter of an oil filter.

2. The invention of claim 1, wherein:

the lever arm has an interior surface defining a lever slot, which has an interior surface defining lever slot holes which mate with the spider pin so that the lever can force the spider arm fore and aft as the lever outer end is moved in the opposite direction generally parallel to the axis, depending on the previous orientation camming surfaces defined by the casing and arcuate elements are forced together to spread the arcuate elements or apart to reduce the diameter of the arcuate elements, thereby causing the arcuate elements to selectively grasp or release an oil filter for insertion or removal.

* * * * *